175-48 SR
12/10/85 XR 4,557,295

United States Patent [19]

Holmes

[11] Patent Number: 4,557,295

[45] Date of Patent: Dec. 10, 1985

[54] FLUIDIC MUD PULSE TELEMETRY TRANSMITTER

[75] Inventor: Allen B. Holmes, Rockville, Md.

[73] Assignee: The United States of America as represented by the Secretary of the Army, Washington, D.C.

[21] Appl. No.: 93,084

[22] Filed: Nov. 9, 1979

[51] Int. Cl.[4] ..... F15C 1/16

[52] U.S. Cl. ..... 137/813; 137/809; 137/810; 175/48

[58] Field of Search ..... 137/809, 812, 813, 810; 175/48, 50

[56] References Cited

U.S. PATENT DOCUMENTS

| | | | |
|---|---|---|---|
| 3,468,326 | 9/1969 | Cohen | 137/809 |
| 3,470,894 | 10/1969 | Rimmer | 137/809 |
| 3,537,466 | 11/1970 | Chaplin | 137/809 |
| 3,631,874 | 1/1972 | Rexford | 137/818 |
| 3,674,044 | 7/1972 | Mayer | 137/812 |
| 3,731,699 | 5/1973 | Hallum | 137/809 |
| 3,756,211 | 9/1973 | Taplin | 137/805 X |
| 3,780,767 | 12/1973 | Borg et al. | 251/127 X |
| 4,134,100 | 1/1979 | Funke | 137/836 |
| 4,276,943 | 7/1981 | Holmes | 137/810 |
| 4,291,395 | 9/1981 | Holmes | 137/810 |
| 4,323,991 | 4/1982 | Holmes et al. | 137/813 |

FOREIGN PATENT DOCUMENTS

| | | | |
|---|---|---|---|
| 1195994 | 6/1970 | United Kingdom | 137/809 |

*Primary Examiner*—A. Michael Chambers
*Attorney, Agent, or Firm*—Saul Elbaum; Thomas E. McDonald; Anthony T. Lane

[57] ABSTRACT

A fluidic pulsing device is disclosed which comprises at least one fluid amplifier and several vortex valve restrictors. One or more amplifiers direct fluid flow to the several vortex valves, which are arranged in parallel fashion. Such an arrangement allows for optimization of design geometries, and therefore, optimization of performance, despite the fact that the physical dimensions of the apparatus may be severely restricted.

19 Claims, 9 Drawing Figures

FLUIDIC MUD PULSE TELEMETRY TRANSMITTER

RIGHTS OF THE GOVERNMENT

The invention described herein may be manufactured, used and licensed by or for the U.S. Government for governmental purposes without the payment to me of any royalty thereon.

BACKGROUND OF THE INVENTION

The usefulness of obtaining data concerning temperature, pressure, etc. from the bottom of an oil, gas, or geothermal well during drilling operations, without interrupting those operations, has been recognized for many years. Mud pulse telemetry is a technique which may be utilized to relay such data from the bottom of the well to the operator of the drill string. In a mud pulse telemetry system a pulsing device is incorporated into a drill collar in the vicinity of the drill bit. A fluid, called mud, is circulated through the drill string, and is used primarily to bring cuttings from the drill bit to the surface where they may be disposed of. The pulsing device creates pressure waves in the mud circulating through the drill string, which are received by a transducer at the earths' surface. The pulses are received at the surface in coded form, representing data gathered in the vicinity of the drill bit. Mud pulse telemetry systems are particularly described in U.S. Pat. No. 4,134,100, and U.S. Pat. Nos. 4,323,991 and 4,276,943.

The mud pulse telemetry systems described in the above mentioned patent and applications utilize a fluidic amplifier which directs flow to a vortex valve restrictor means. In designing these fluidic circuits, one is severely limited by the fact that the entire device must fit inside the very confined space of a drill collar. Component response could not be optimizedbecause space constraints were inconsistent with high flow requirements. For example, it is highly desirable to have a relatively small vortex valve diameter, which will yield more rapid response and higher pulse frequencies. Still, it is necessary that the outlet area of the vortex valve be large enough to accomodate the fluid flow which must pass therethrough. While the outlet area must be large enough to accomodate fluid flow, it is desirable that it be small in relation to the valve diameter in order to increase the turndown ratio (ratio of maximum fluid flow to minimum fluid flow through the valve). It is also desirable that the outlet area be relatively small in order to avoid undesirable pressure drops through the fluid amplifier. It is evident that all of these competing considerations can not be simultaneously satisfied using a singular amplifier and vortex valve.

Accordingly, it is an object of the invention to overcome the above named disadvantages and design problems.

It is another object of the invention to provide a fluidic mud pulser system which allows for the use of optimized flow geometries.

It is still another object of the invention to provide a mud pulser which allows for increased frequency response.

Another object of the invention is to increase signal output power of a fluidic mud pulser, and to reduce actuator power requirements.

SUMMARY OF THE INVENTION

The device disclosed and claimed overcomes the above mentioned design restraints, and allows for optimization of design parameters. The apparatus comprises one or more fluid amplifiers directing flow to several vortex restrictor valves arranged in parallel fashion. This enables the operator to provide smaller valves, thus maximizing frequency and turndown ratio. While the outlet area of each vortex restrictor may be small, the total outlet area is sufficient to permit the required flow to pass therethrough.

DESCRIPTION OF THE PREFERRED EMBODIMENTS

Figure 1:
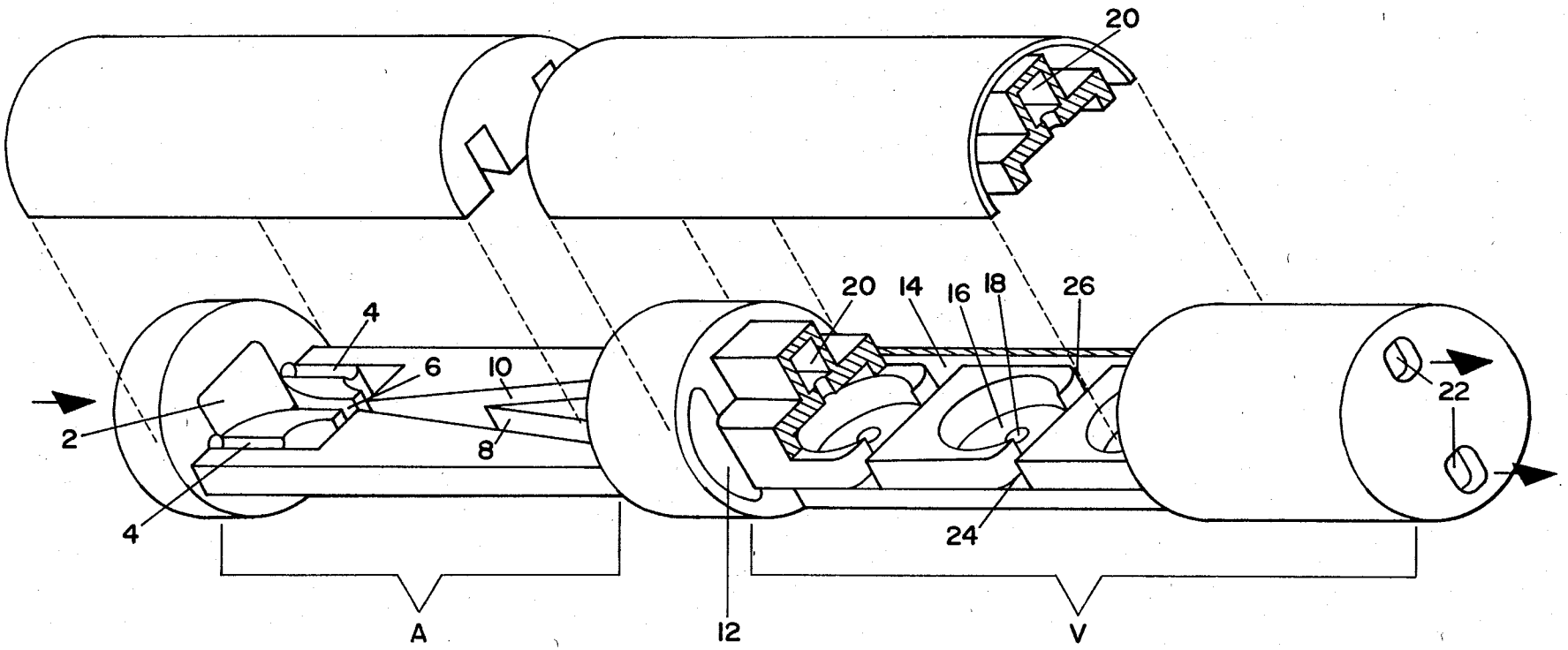
FIG. 1 depicts a first embodiment of the invention.
Figure 5C:
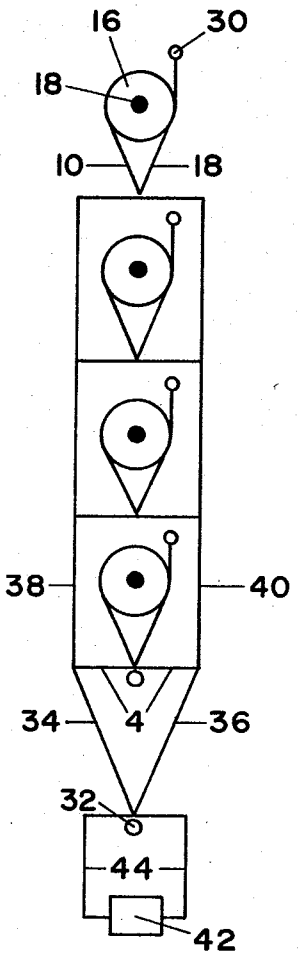
FIGS. 5*a*–5*c* illustrate various forms of the embodiment of FIG. 3.
Figure 5B:
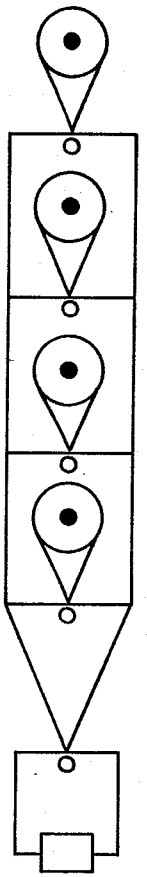
Figure 5A:
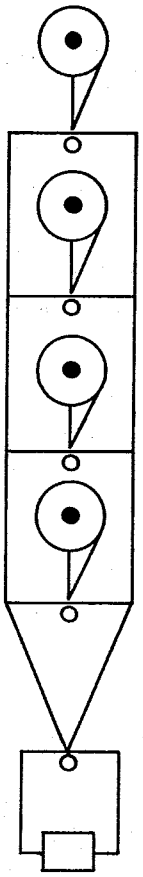
Figure 2C:
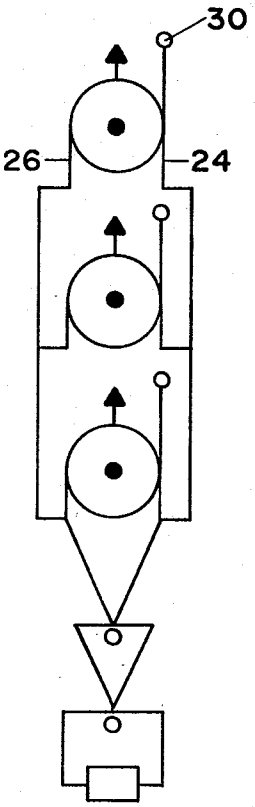
FIGS. 2*a*–2*c* illustrate various forms of the invention shown in FIG. 1.
Figure 2B:
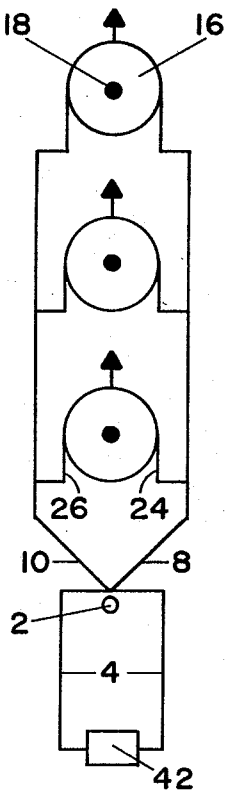
Figure 2A:
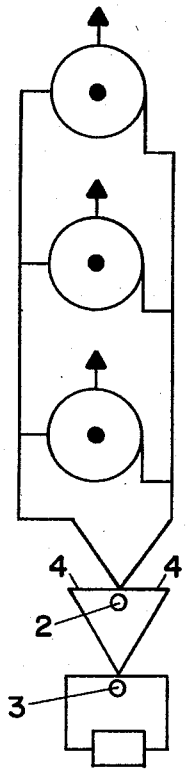

Referring to FIG. 1, an exploded view of a first embodiment of the invention is shown. The apparatus comprises an amplifier section or module A, and a valve section or module V. The device has an overall cylindrical configuration as shown, and is dimensioned to fit within a drill collar of a drill string.

Mud flowing through the drill string enters the bistable fluid amplifier through inlet 2, forming a power flow through nozzle 6. As is well known in the art, the power flow will attach to the wall of either of outlets 8 or 10. Control ports 4 are provided by means of which control pulses may be applied to the power flow to divert the flow from one outlet to the other. Flow through outlets 8 or 10 pass through passages 12 into manifolds 14, provided symmetrically on both sides of the vortex valves 16.

Each vortex valve 16 comprises dual outlets 18 and tangential inlets 24 and 26 entering the valves from the respective manifolds 14. The outlets 18 enter outlet manifolds 20, provided symmetrically above and below the valves, communicating with outlet ports 22.

As fluid flows alternately in the respective manifolds 14, fluid entering either of inlets 24 or 26 will act to periodically reverse the direction of vortical flow in each of the restrictor valves 16. Each time the vortical velocity is maximized, the restrictive effect of the valve is also maximized, thus reducing flow through the device. Each time the vortical velocity passes through 0 as the direction of the vortex is reversed, flow through the valve is maximized. The result is a series of shock waves or pressure pulses (water hammer) which proprogate through the fluid mud flowing in the drill string. The manner in which this occurs is more particularly described in the above noted U.S. Pat. Nos. 4,276,943 and 4,323,991.

The device shown in FIG. 1 utilizes a single fluid amplifier to control fluid flow directly to multiple vortex valves. The overall size of each valve may be kept small, thereby maximizing frequency output which can be attained by minimizing the time required to reverse the direction of the vortical flow in the valve. The outlet area of each valve may be suitably small in relation to the valve diameter to increase the turndown ratio and to maintain pressure in the amplifier. Simultaneously, flow requirements may be met by providing a sufficient number of valves so that the total outlet area is capable of handling the necessary mud flow through the drill string.

The amplifier module A and the valve module V may be formed as a single unit, or more conveniently formed as separate units which may be joined together in fluid tight relationship. In this manner the module A may be joined with various modules V, each comprising a differing number of valves 16. Also, the valve module V may be constructed in such manner that the number of valves may be varied within the module. The number of operable valves may also be varied by simply plugging one or more of the valves within the module when it is desirable to utilize fewer than all of the valves provided in the module.

FIGS. *2a–2c* illustrate various forms of the device of FIG. 1. The embodiment shown in FIG. *2b* corresponds to that of FIG. 1, with like elements being indicated by the same reference numerals. Electromechanical actuator 42 is provided for generating control pulses for deflecting the power flow in the amplifier. The actuator may comprise a solenoid operated bellows device in fluid communication with control ports 4. Movement of the actuator creates a pressure pulse in either of ports 4 for deflecting the power flow through port 6. This particular actuator is more fully described in U.S. Pat. Nos. 4,323,991 and 4,276,943.

FIG. *2a* illustrates an embodiment similar to that of FIG. *2b*. The control portion of the circuit of FIG. *2a* comprises an actuator and two cascaded fluid amplifiers, having respective inlets 3 and 2, for boosting the power of the control signals to the ports 4. This reduces the amount of electrical energy required for the actuator 42. This is highly desirable due to the fact that available power for the actuator in the drill collar is very limited as it is provided by batteries or a fluid mud turbine. Also the vortex valves in the embodiment of FIG. *2a* comprise two inlets, one of which is tangential, one of which is radial, as opposed to the dual tangential inlets of FIG. *2b*. The structure and operation of the vortex valves as shown in FIG. *2a* is more particularly described in U.S. Pat. No. 4,323,991.

FIG. *2c* shows an embodiment having cascaded amplifiers and vortex valves which comprise three tangential inlets. As can be seen more clearly in FIG. 3, fluid flow will enter continuously through inlet 30. When fluid is also flowing through inlet 24, the net vortical velocity will be zero resulting in maximum flow through vortex valves. When fluid is flowing through inlet 26, vortical velocity generated by the flows from inlets 26 and 30 will be supplemental to one another, thus generating very intense vortex in the valves. The rapid vortex will greatly minimize the flow through the valves, resulting in very high turndown ratio. Also the greater inlet to outlet area resulting from the provision of two inlets, 30 and 26, acts to maintain pressure in the fluid amplifiers.

Figure 3:
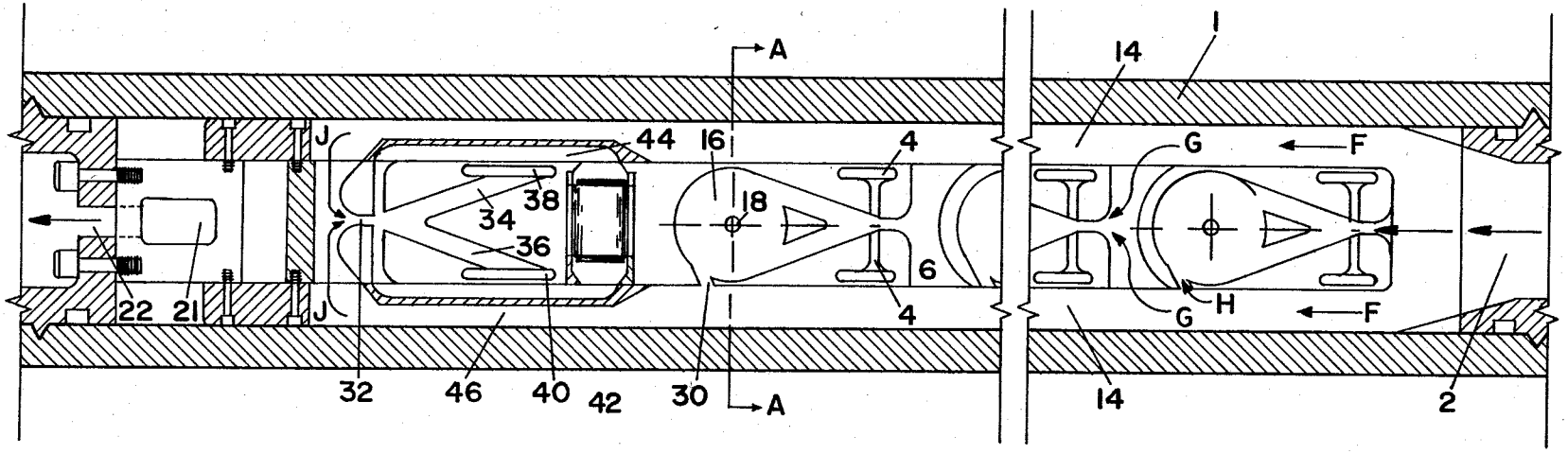
FIG. 3 is a sectional view of a second embodiment of the invention.
Figure 4:
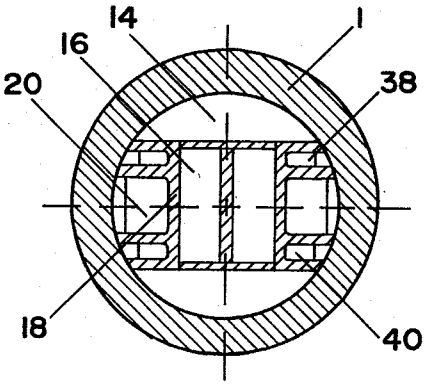
FIG. 4 is a sectional view along line A—A of FIG. 3.

FIGS. 3 and 4 show a second preferred mode of construction of the invention. Cylindrical housing 1 is dimensioned to fit within or form part of a drill string. Mounted within the housing are several vortex valves 16 having outlets 18 as previously described. Cooperating with each vortex valve is a fluid amplifier having power flow inlet 6, control ports 4, and flow paths 8 and 10 communicating with the vortex valve. Optional tangential inlet 30, as discussed above, may also be provided for each vortex valve.

Flow enters the housing 1 through inlet 2, and enters inlet manifolds 14, as indicated by arrows F in FIG. 3. Power flow into each inlet 6 enters from manifolds 14, as shown by arrows G. If optional inlets 30 are provided, flow enters as shown by arrow H, from the manifold 14.

Control pulses for the various amplifiers are generated as follows. Flow from manifolds 14 enter a power flow inlet 32 as shown by arrows J in FIG. 3. Inlet 32 comprises the power inlet of what is a bistable fluid amplifier having flow paths 34 and 36. Paths 34 and 36 communicate with control manifolds 38 and 40, respectively. An electromechanical actuator 42 is provided in communication with control ports 44 and 46. These control ports communicate with the power flow through inlet 32 to selectively divert the flow to path 34 or 36. This flow will enter manifold 38 or 40, each of which is in fluid communication with a set of control ports 4. As the flow from inlet 32 is diverted into either manifold 38 or manifold 40, a fluid pressure pulse is received at either the upper or lower set of control ports 4, as seen in FIG. 3.

The fluid amplifiers and vortex valves of the embodiment of FIG. 3 operate in the same manner as previously described with respect to FIG. 1. Fluid passing through outlets 18 enter outlet manifolds 20, as seen in FIG. 4. From outlet manifolds 20 the flow passes through radial passages 21, through axial outlet port 22.

It is to be understood that the additional tangential inlet 30 is optional. It may be provided at the option of the operator when significantly enhanced performance, as previously described, is desired.

FIGS. *5a–5c* illustrate various forms of the embodiment of the invention shown in FIG. 3. The device shown in FIG. 3 corresponds to the embodiment of FIG. *5c*. The arrangement of FIG. *5a* comprises vortex valves having one radial and one tangential inlet, as previously described. The embodiment of FIG. *5b* is substantially similar to that of FIG. *5c*, the difference being that additional tangential inlets 30 are not provided. The apparatus of any of FIGS. *5a* through *5c* may also comprise cascaded control amplifiers, as shown in FIGS. *2a* and *2c*, in order to reduce the power required to operate the actuator 42.

Various features of the respective embodiments of FIGS. 1 and 3 may be interchanged to yield modified embodiments of the invention. For example, the device of FIG. 3 comprises two rows of vortex valves 16 arranged in back to back fashion, as seen in FIG. 4. This arrangement is not essential, and the device may comprise a single row of valves, as shown in FIG. 1. Likewise the single row of amplifiers in the embodiment of FIG. 1 may be replaced with a dual row of back to back vortex valves, as shown in FIG. 4. In any of the embodiments disclosed, the bistable fluid amplifiers can be replaced by fluidic oscillators, as shown in U.S. Pat. No. 4,134,100 or U.S. Pat. No. 4,291,395.

The invention allows designing a fluid mud pulsing system which has increased power output, that is, the magnitude of the pressure pulses is increased, yet requires reduced actuator power. Use of several smaller vortex valves allows for greater maximum frequency of pulsing without sacrificing flow capacity. High turndown ratios can be achieved because optimum geometric design ratios can be employed.

For a given set of circulating flow conditions and drill nozzle bit area there is a corresponding pulser effective area (total area of vortex valve outlets) which will produce optimum signal levels. The proper relationship between nozzle bit area and pulser area can be easily achieved by providing more or fewer amplifier and vortex valve stages. This may be done by simply plugging or unplugging one or more valve outlets. Also since all pulser stages are identical in form, they may be manufactured as modules which are interchangeable with one another. They may readily be formed in such manner that they may be strung together facilitating the formation of a multistage pulser having any number of desired stages. Further, if the stages are designed to be interchangeable, one may interchange various stages having different valve diameters, outlet diameters, etc., in order to obtain maximum efficiency.

Though various preferred embodiments have been shown and described, it will be recognized that various modifications and substitutions may be made thereto without departing from the spirit and scope of the invention. Accordingly, I wish it to be understood that I do not desire to be limited to the exact details of construction shown and described, for obvious modifications can be made by a person skilled in the art.

I claim:

1. A fluid control device comprising:

at least two vortex valves arrayed in parallel; and common regulating means to regulate the flow to said valves by selectively passing flow to one of two paths to control the amount of flow through the valves, wherein said regulating means comprises a first fluid amplifier having outlet paths, and at least two second fluid amplifiers associated respectively with said at least two vortex valves, and second fluid amplifier having first and second outlet paths communicating with its associated vortex valve and having control ports for controlling the flow of fluid in the second fluid amplifier, the outlet paths of said first fluid amplifier communicating with the control ports of said second fluid amplifiers.

2. A device as in claim 1, wherein the valves are interchangeable, and the number of valves associated with the device may be selectively increased or decreased.

3. A device as in claim 1 wherein:

the first outlet path of each second fluid amplifier communicates radially with its associated vortex valve; and the second outlet path of each second fluid amplifier communicates tangentially with its associated vortex valve.

4. A device as in claim 1 wherein:

the first outlet path of each second fluid amplifier communicates with its associated vortex valve in a first tangential direction; and the second outlet path of each second fluid amplifier communicates with its associated vortex valve in a second tangential direction opposite said first tangential direction.

5. A device as in claim 4, further comprising a third inlet to each vortex valve communicating with the vortex valve in either said first or second tangential direction.

6. A pulsing device for generating pulses in a flowing fluid, comprising:

at least two vortex valves arranged in parallel; and common regulating means for regulating flow of fluid to the valves to alternately impede and facilitiate flow through the valves, wherein said regulating means comprises a first means having outlet paths, and at least two fluid amplifiers associated respectively with said at least two vortex valves, each fluid amplifier having control ports for controlling the flow of fluid through the amplifier and having first and second outlet paths communicating with its associated vortex valve, the outlet paths of said first means communicating with the control ports of said amplifiers.

7. A device as in claim 6 wherein said first means is a fluid amplifier.

8. A device as in claim 6 wherein:

said first outlet path of each fluid amplifier communicates radially with its associated vortex valve; and said second outlet path of each fluid amplifier communicates tangentially with its associated vortex valve.

9. A device as in claim 6 wherein:

said first outlet path of each fluid amplifier communicates with its associated vortex valve in a first tangential direction; and said second outlet path of each fluid amplifier communications with its associated vortex valve in a second tangential direction opposite said first tangential direction.

10. A device as in claim 9 further comprising a third inlet to said vortex valves communicating with said vortex valves in either said first or second tangential direction.

11. A device as in claim 6 wherein the valves are interchangeable and the number of valves associated with the device may be selectively increased or decreased.

12. A device for drilling comprising: a drill collar; drill bit means contained in said collar for drilling earth; electronic means to make measurements concerning conditions surrounding said drill bit means; means for carrying drilling mud between said drill collar and the surface contained within said drill collar to transmit pressure pulses reflecting measurements made by said electronic means of said drill bit to the surface through drilling mud and comprising at least two vortex valves arrayed in parallel; a common regulating means to regulate flow to said valves; and a transducer at the surface to receive the pressure pulses of said mud pulser.

13. The device as claimed in claim 12 wherein the regulating means comprises a single fluid amplifier having a first and a second outlet path communicating with said vortex valves, the single fluid amplifier selectively passing flow to one of the first and second outlet paths to control the amount of flow through the valves.

14. The device as claimed in claim 12 wherein said regulating means comprises:

a first fluid amplifier having fluid outlet paths; and at least two second fluid amplifiers associated respectively with said at least two vortex valves, each second fluid amplifier having first and second outlet paths communicating with its associated vortex valve and having control ports for controlling the flow of fluid in the second fluid amplifier to selectively pass flow to one of the first and second outlet paths to control the amount of flow through its associated vortex valve, the outlet paths of said first fluid amplifier communicating with the control ports of said second fluid amplifiers.

15. The device as claimed in claim 13 or 14 wherein the valves are interchangeable and the number of valves associated with the device may be selectively increased or decreased.

16. A device as in claim 13, wherein:

the first outlet path of the single fluid amplifier communicates with the vortex valves radially; and the second outlet path of the single fluid amplifier communicates with the vortex valves tangentially.

17. A device as in claim 13, wherein:

the first outlet path of the single fluid amplifier communicates with the vortex valves in a first tangential direction; and the second outlet path of the single fluid amplifier communicates with the vortex valves in a second tangential direction opposite the first tangential direction.

18. A device as in claim 17, further comprising a third inlet to each vortex valve communicating with the vortex valve in either said first or second tangential direction.

19. A device as in claim 13, wherein said regulating means further comprises an additional fluid amplifier having output paths, said single fluid amplifier having control ports to control the flow of fluid within said single fluid amplifier, the output paths from said additional amplifier communicating with the control ports of said single amplifier whereby reduced power is required to control the flow of fluid through said single amplifier.

* * * * *